US009278242B2

(12) United States Patent
Winn

(10) Patent No.: US 9,278,242 B2
(45) Date of Patent: Mar. 8, 2016

(54) POMMEL HORSE DEVICE

(71) Applicant: Timothy Stephen Winn, Lexington, KY (US)

(72) Inventor: Timothy Stephen Winn, Lexington, KY (US)

( * ) Notice: Subject to any disclaimer, the term of this patent is extended or adjusted under 35 U.S.C. 154(b) by 0 days.

(21) Appl. No.: 13/937,195

(22) Filed: Jul. 8, 2013

(65) Prior Publication Data

US 2014/0011641 A1 Jan. 9, 2014

Related U.S. Application Data

(60) Provisional application No. 61/669,661, filed on Jul. 9, 2012.

(51) Int. Cl.
*A63B 5/12* (2006.01)

(52) U.S. Cl.
CPC ..... *A63B 5/12* (2013.01); *A63B 2210/50* (2013.01)

(58) Field of Classification Search
CPC ..... A63B 21/00
USPC ..... 482/25, 35; 220/4.27, 254.1, 254.2; 297/423.41
See application file for complete search history.

(56) References Cited

U.S. PATENT DOCUMENTS

| | | | | | |
|---|---|---|---|---|---|
| 941,665 | A | * | 11/1909 | Thornley | 482/25 |
| 1,013,685 | A | * | 1/1912 | Reach | 482/25 |
| 3,767,191 | A | * | 10/1973 | Riley | 482/25 |
| 4,203,525 | A | * | 5/1980 | Okubo | 220/4.26 |
| 4,410,174 | A | * | 10/1983 | Hamada | 482/25 |

* cited by examiner

*Primary Examiner* — Jerome W Donnelly

(57) ABSTRACT

A pommel horse device for gymnastic training does not require younger users to be constantly supervised with a spotter when using them. The pommel horse device has a height lower than conventional pommel horse devices, typically at about 15 inches as compared to about 63 inches for conventional pommel horse devices. The pommel horse device has three holes in the top for the optional attachment of pommel handles.

10 Claims, 4 Drawing Sheets

POMMEL HORSE DEVICE

CROSS-REFERENCE TO RELATED APPLICATION

This application claims the benefit of priority of U.S. provisional application No. 61/669,661, filed Jul. 9, 2012, the contents of which are herein incorporated by reference.

BACKGROUND OF THE INVENTION

The present invention relates to a pommel horse device for gymnastic training and, more particularly, to a low height pommel horse device.

Current pommel horse devices for gymnastic training are very difficult to use—especially for young or inexperienced users. Current pommel horse devices stand approximately 64 inches above the floor, requiring the use of a spotter for younger users and significant expensive matting requirements. In addition, current pommel horse devices are too long for practical use for young users. The cost of a current pommel horse device is so high that it makes the entry into boy's gymnastics difficult for many gyms to justify. Unfortunately, current pommel horse devices are not safe and younger users are required to be constantly supervised when using them. This greatly inhibits the potential development of pommel horse skills.

As can be seen, there is a need for a pommel horse device that does not require that younger or less experienced users be constantly supervised by the coach when using them. This sort of pommel horse device can also allow gyms to offer boys gymnastics more readily—at a fraction of the standard competition sized pommel horse.

SUMMARY OF THE INVENTION

In one aspect of the present invention, a pommel horse device comprises a base having; a top attached to the base; a plurality of pommel nut access holes formed in a top surface of the base; and a plurality of holes formed through the top and into pommel access cavities formed in the top, wherein the pommel horse device has a height from about 15 to about 20 inches.

In another aspect of the present invention, a pommel horse device comprises a base having; a top removably attached to the base; a top cushion disposed on the top; pommel nut access holes formed in a top surface of the base; holes formed through the top and into pommel access cavities formed in the top, the holes accessible through pommel nut access holes; bolts fitting through bolt slots in the base, the bolts threaded into nuts formed in mortises in the top when the top is attached to the base; and one or more pommel handles having handle bolts fitting through holes formed through the top and into the pommel access cavities; and nuts fitting into the pommel access cavities to secure the pommel handles to the top of the pommel horse device, wherein the pommel horse device has a height of about 20 inches.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a pommel horse device for gymnastic training that does not require younger users to be constantly supervised when using them. The pommel horse device has a height lower than conventional pommel horse devices, typically at about 15 inches as compared to about 63 inches for conventional pommel horse devices. The pommel horse device has three holes in the top for the optional attachment of pommel handles.

Figure 1:
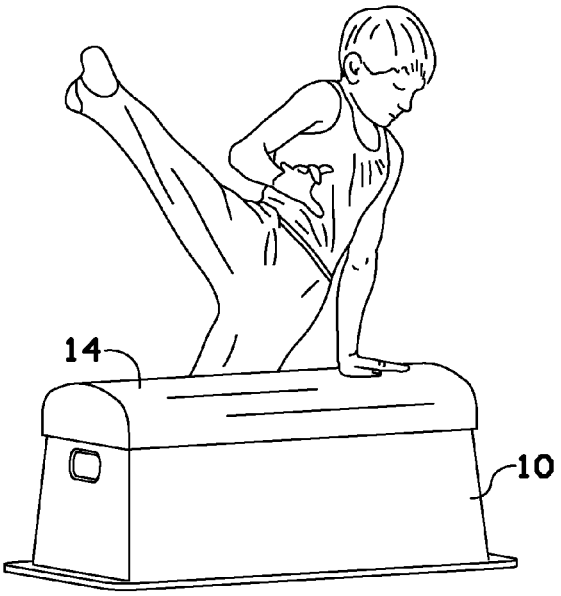
FIG. 1 is a perspective view of a pommel horse device, in use, according to an exemplary embodiment of the present invention.
Figure 2:
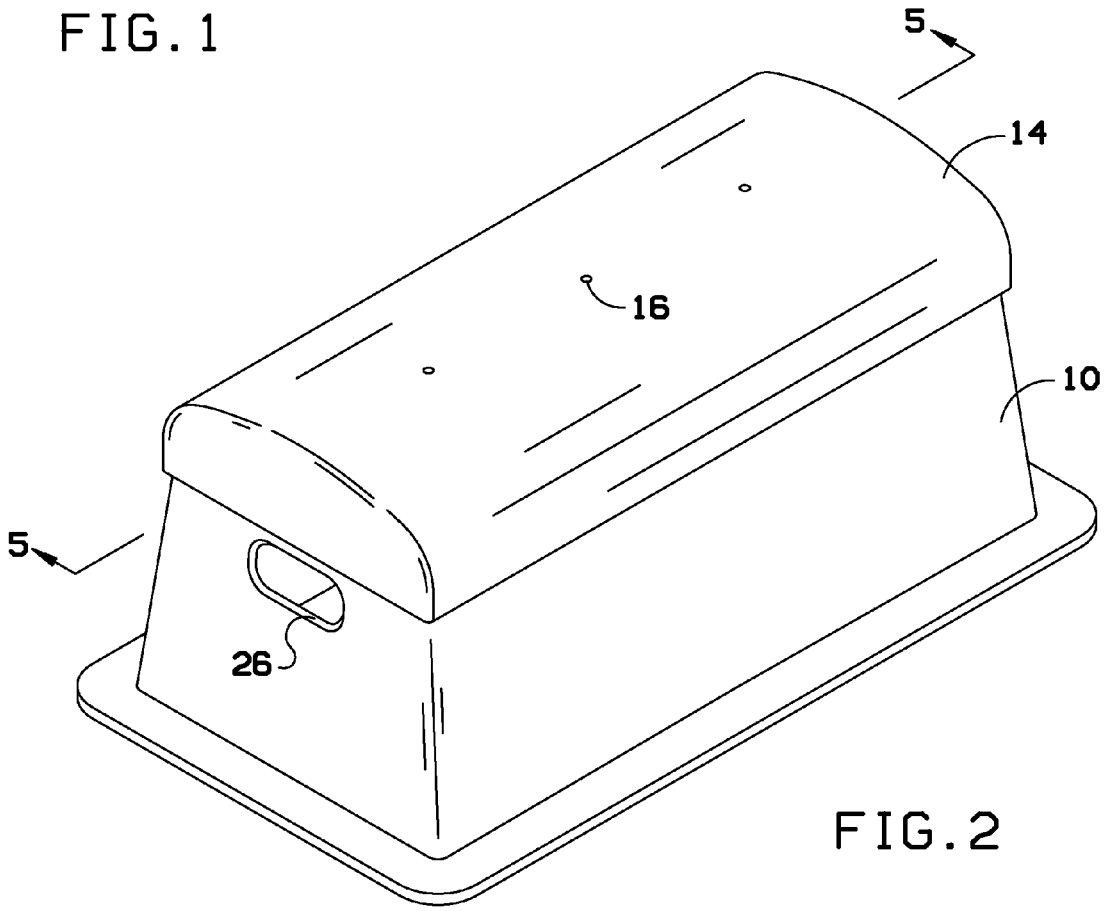
FIG. 2 is a perspective view of the pommel horse device of FIG. 1.
Figure 4:
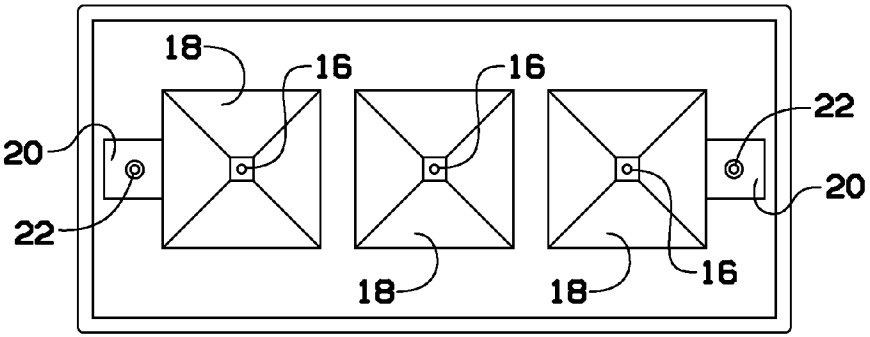
FIG. 4 is a bottom view of the pommel horse device of FIG. 1.
Figure 5:
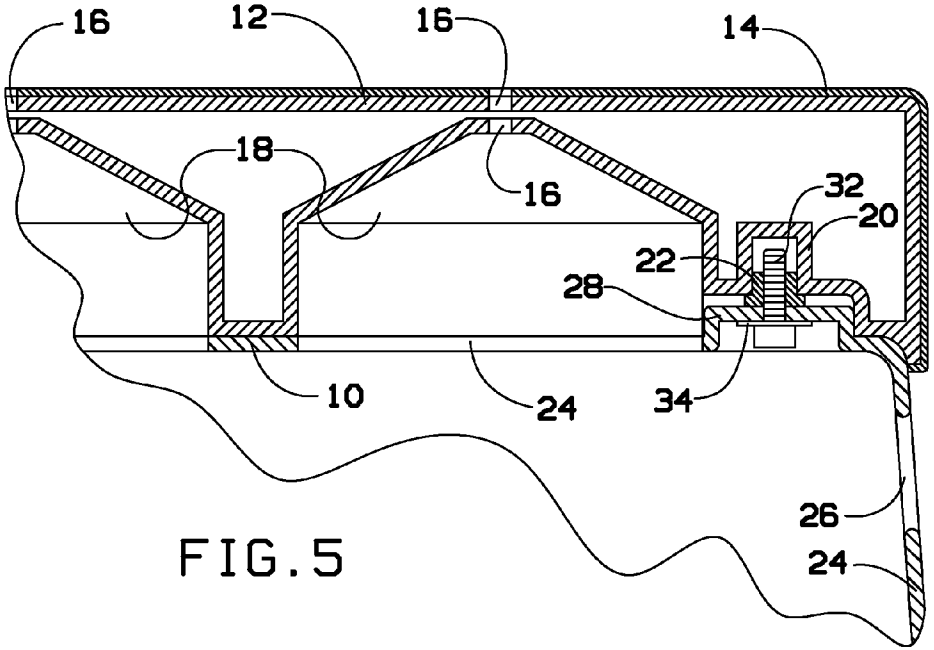
FIG. 5 is a cross-sections view taken along line 5-5 of FIG. 2.
Figure 3:
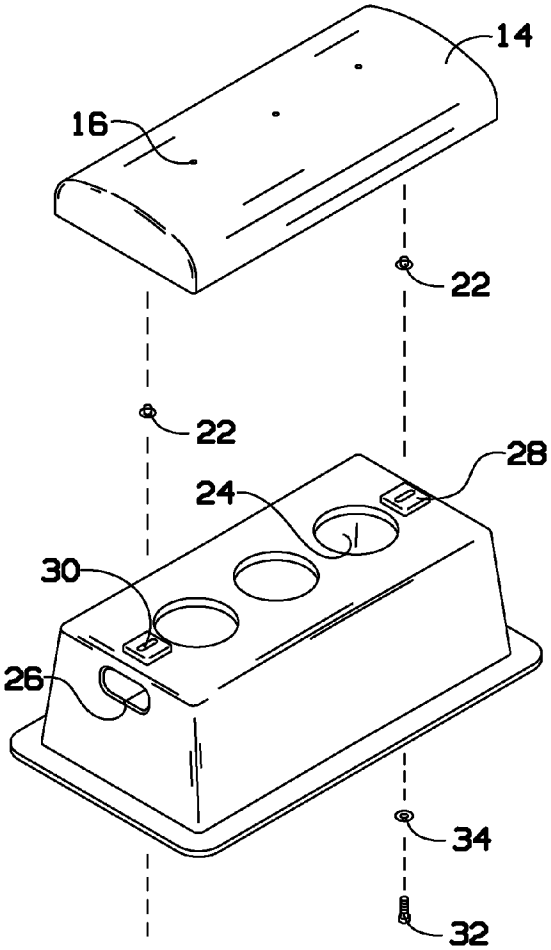
FIG. 3 is an exploded perspective view of the pommel horse device of FIG. 1.
Figure 6:
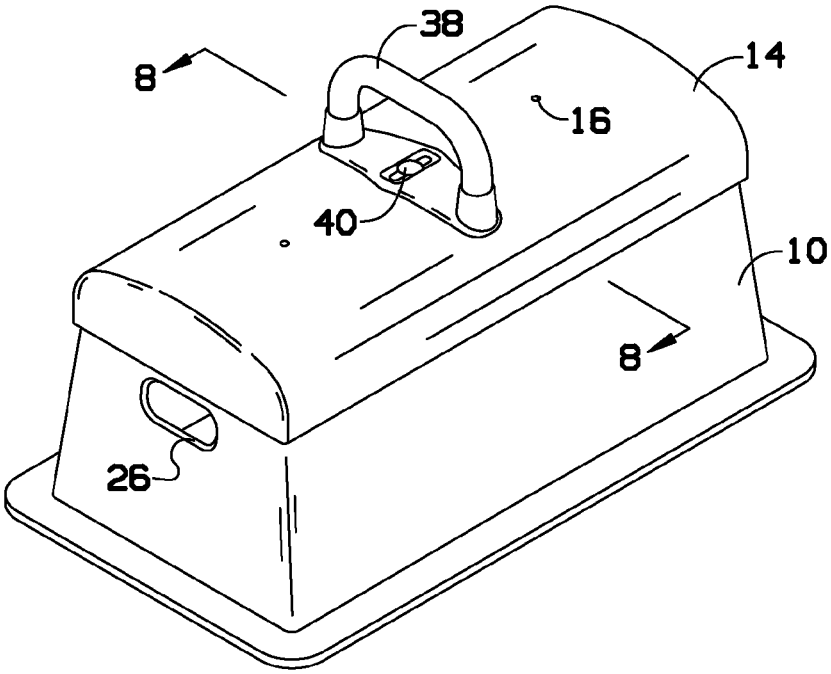
FIG. 6 is a perspective view of a pommel horse device with one pommel.
Figure 7:
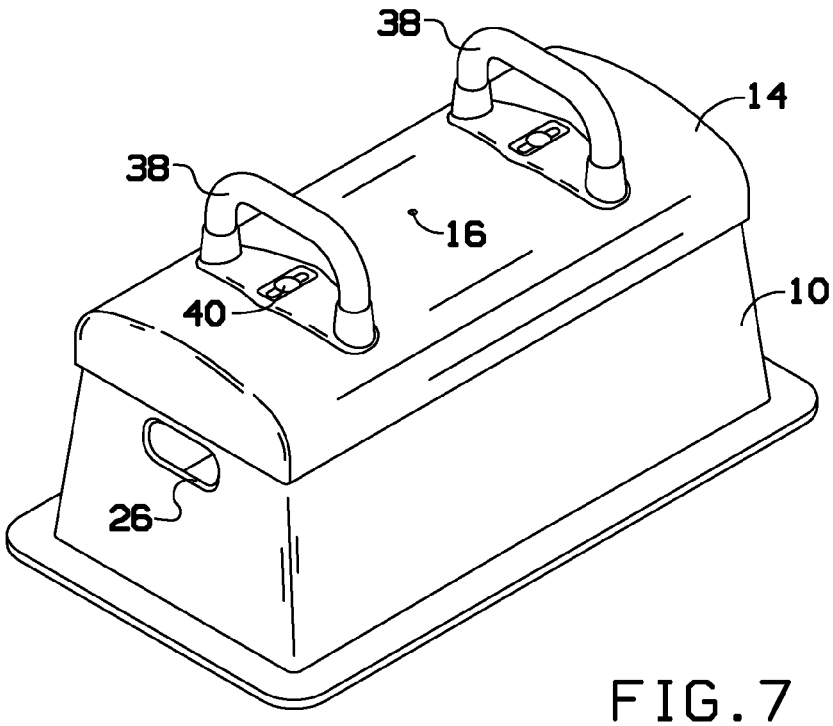
FIG. 7 is a perspective view of a pommel horse device with two pommels.
Figure 8:
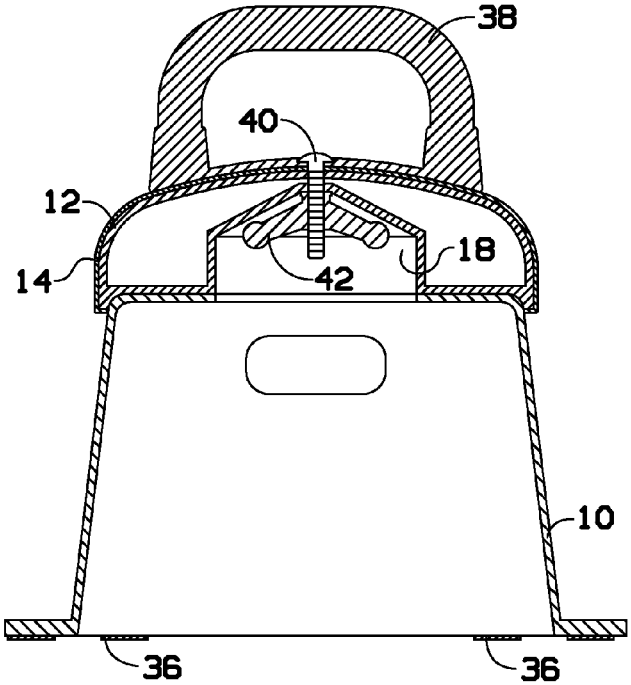
FIG. 8 is a cross sectional view taken along line 8-8 of FIG. 6.
Figure 9:
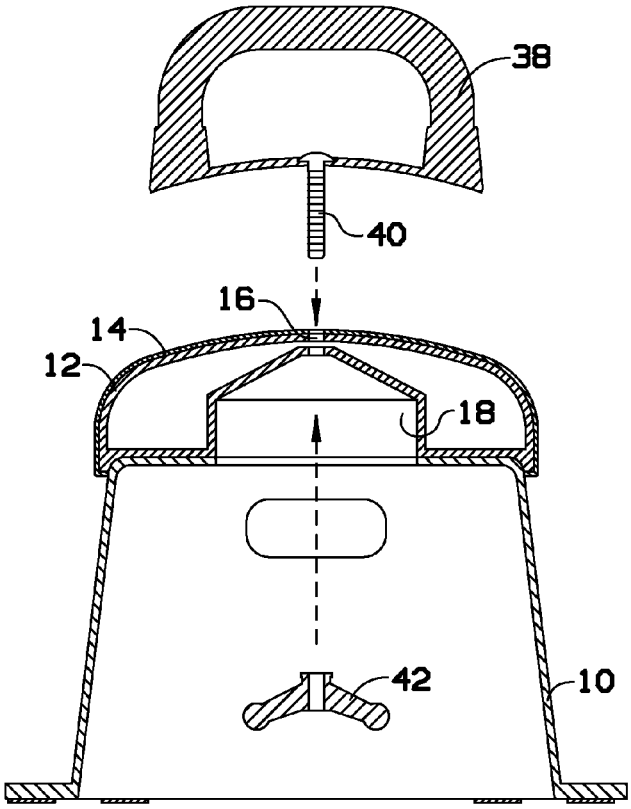
FIG. 9 is an exploded cross-sectional view, illustrating connection of the pommel to the top of the pommel horse device.

Referring now to FIGS. 1 through 9, a pommel horse device according to an exemplary embodiment of the present invention may include a flanged molded trapezoidal shape housing 10 (also referred to as base 10) and a padded top 12 secured to the base 10. The top 12 can include a top cushion 14 to provide a padded external surface.

The base 10 may be made of a sturdy material, for example, polyethylene, by molding or extrusion molding. The base 10 may be rectangular and have dimensions of approximately 35.5 inches in length and approximately 20 inches in width at the bottom narrowing to the top for optimum stability.

A plurality of holes may be drilled or recessed into a flange area of the base 10. A rubber pad 36 may be inserted into each hole 10 to prevent the pommel horse device from moving during use. A logo may be attached to the base 10 as desired.

Side openings 26 may be formed on sides of the base 10. The side openings 26 may be designed to receive the hands of the user to facilitate the transportation of the pommel horse device.

In some embodiments, the padded top 12 can be designed to be the exact shape of a standard competition pommel horse. The padded top 12 may be connected to the trapezoidal shape base 10 by using two bolts 32 and washers 34, where the bolts can be inserted through bolt slots 30 formed in the tenons 28 in the top of the base 10 and threaded into two inset T-nuts 22. The T-nuts 22 can be incorporated during the molding process into mortises 20 formed in the bottom of the padded top 12.

The top cushion 14 can be made of a foam material. A layer of urethane (or vinyl or other similar material) material may cover the top 12. The top cushion 14 may provide the pommel horse device with the exact same look and feel of a standard competition pommel horse.

The top cushion 14 and the layer of urethane or vinyl material may be joined together by using flame lamination. Then, the layers may be molded and sealed around the entire surface area of the top 12.

The padded top 12 has the capability for the user to attach any standard pommel handles 38 with standard wing-shaped nuts 42 in any of the plurality of top holes 16 formed through the padded top 12 and in pommel access cavities 18 formed in the padded top 12. The base 10 can include pommel nut access holes 24 to allow the user to access pommel access cavities 18 to tighten or remove the nuts 42 on or off of pommel bolts 40 of pommel handles 38, to attach or remove the pommel handles 38. The pommel handles 38 may provide the pommel horse device with the exact realism of the competition pommel horse. In addition, the handle(s) 38 will greatly expand the number of skills that the user may practice.

The pommel horse device may have a height of approximately 15 to 20 inches depending on whether pommel handles are attached, which provide the user to gain a true feel of the often intimidating standard competition size pommel horse in a far safer and more inviting format.

The pommel horse device may be used at any location, for example, a gymnasium, a house, a club, or a meet. The Pommel Horse device 10 may allow the coach to have a work station that may not require the use of spotters optimizing the practice time for the coach and gymnast.

The pommel horse device may be of a small, lightweight device that may be easily moved to a different location.

It should be understood, of course, that the foregoing relates to exemplary embodiments of the invention and that modifications may be made without departing from the spirit and scope of the invention as set forth in the following claims.

What is claimed is:

1. A pommel horse device comprising:

a base providing a base height;

a top attached to the base;

a plurality of pommel nut access holes formed in a top surface of the base; and a plurality of top holes formed through the top and into pommel access cavities formed in the top, wherein the pommel horse device has an overall height of approximately 15 to approximately 20 inches.

2. The pommel horse device of claim 1, further comprising one or more pommel handles having handle bolts fitting through the plurality of top holes formed through the top and into the pommel access cavities; and nuts fitting into the pommel access cavities to secure the pommel handles to the top of the pommel horse device.

3. The pommel horse device of claim 1, wherein the plurality of top holes are three top holes formed through the top and into the pommel access cavities, and wherein the plurality of pommel nut access holes includes three pommel nut access holes, one for each of the plurality of top holes.

4. The pommel horse device of claim 1, further comprising a top cushion disposed on the top.

5. The pommel horse device of claim 1, wherein the top is removable attached to the base.

6. The pommel horse device of claim 1, further comprising bolts fitting through bolt slots in the base, the bolts threaded into nuts formed in mortises in the top when the top is attached to the base.

7. The pommel horse device of claim 1, further comprising side openings formed in opposite sides of the base.

8. A pommel horse device comprising:

a base providing a base height;

a top removably attached to the base;

a top cushion disposed on the top;

a plurality of pommel nut access holes formed in a top surface of the base;

a plurality of top holes formed through the top and into pommel access cavities formed in the top, the holes accessible through pommel nut access holes;

bolts fitting through bolt slots in the base, the bolts threaded into nuts formed in mortises in the top when the top is attached to the base; and one or more pommel handles having handle bolts fitting through the plurality of top holes formed through the top and into the pommel access cavities; and nuts fitting into the pommel access cavities to secure the pommel handles to the top of the pommel horse device, wherein the pommel horse device has a height of approximately 15 to approximately 20 inches depending on whether the pommel handles are attached to the pommel horse device.

9. The pommel horse device of claim 8, wherein the plurality of top holes are three top holes formed through the top and into the pommel access cavities, and wherein the plurality of pommel nut access holes includes three pommel nut access holes, one for each of the plurality of top holes.

10. The pommel horse device of claim 8, further comprising side openings formed in opposite sides of the base.

* * * * *